United States Patent [19]

Totten

[11] Patent Number: 4,899,791

[45] Date of Patent: Feb. 13, 1990

[54] LIQUID LEVEL CONTROL APPARATUS

[75] Inventor: Roger W. Totten, Lakewood, Colo.

[73] Assignee: Adolph Coors Company, Golden, Colo.

[21] Appl. No.: 305,072

[22] Filed: Feb. 2, 1989

[51] Int. Cl.[4] ..... B67C 3/26

[52] U.S. Cl. ..... 141/288; 141/266; 141/198

[58] Field of Search ..... 141/94–96, 141/192, 198, 266, 288, 289, 40

[56] References Cited

U.S. PATENT DOCUMENTS

| | | | |
|---|---|---|---|
| 2,463,922 | 3/1949 | Turner | 141/288 |
| 2,761,607 | 9/1956 | Ayars | 141/289 X |
| 2,897,855 | 8/1959 | Vadas | 141/288 X |
| 3,420,281 | 1/1969 | Tidwell | 141/40 |
| 4,614,214 | 9/1986 | Cappellina | 141/288 |
| 4,798,234 | 1/1989 | Dugan | 141/165 |

FOREIGN PATENT DOCUMENTS

| | | | |
|---|---|---|---|
| 2123866 | 11/1978 | Fed. Rep. of Germany | 141/288 |

*Primary Examiner*—Ernest G. Cusick

*Attorney, Agent, or Firm*—Klaas & Law, Joseph J. Kelly, Bruce G. Klaas

[57] ABSTRACT

Apparatus is provided for each can filler unit of a can filling machine comprising a support for holding a liquid level controller within a housing of the can filler unit and control apparatus operated from outside of the housing for moving the support to position the liquid level controller at a proper position to ensure that each can is being accurately filled.

9 Claims, 1 Drawing Sheet

FIG. 1 (PRIOR ART)
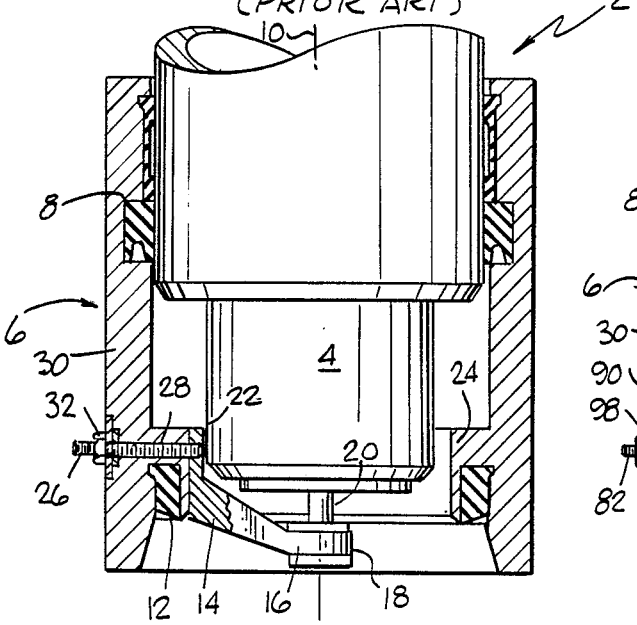
FIG. 2
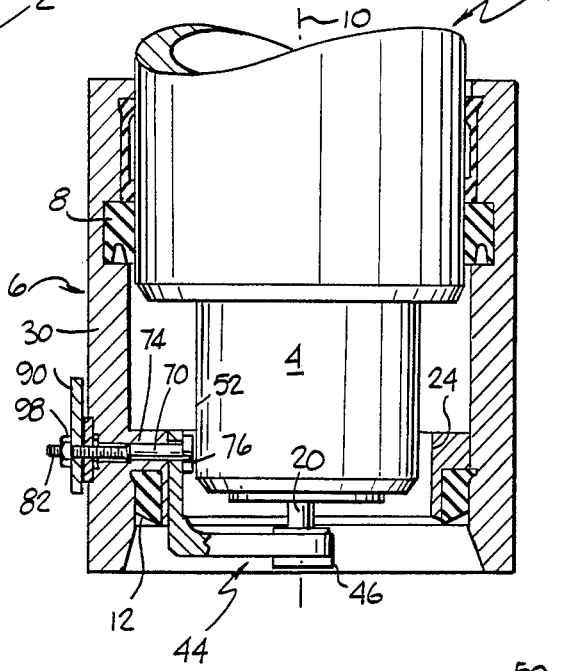
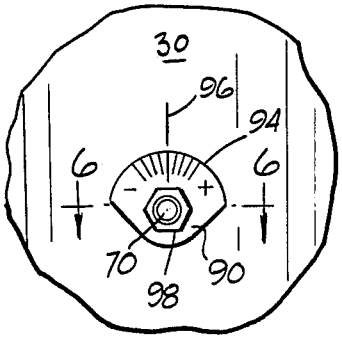
FIG. 3
FIG. 4
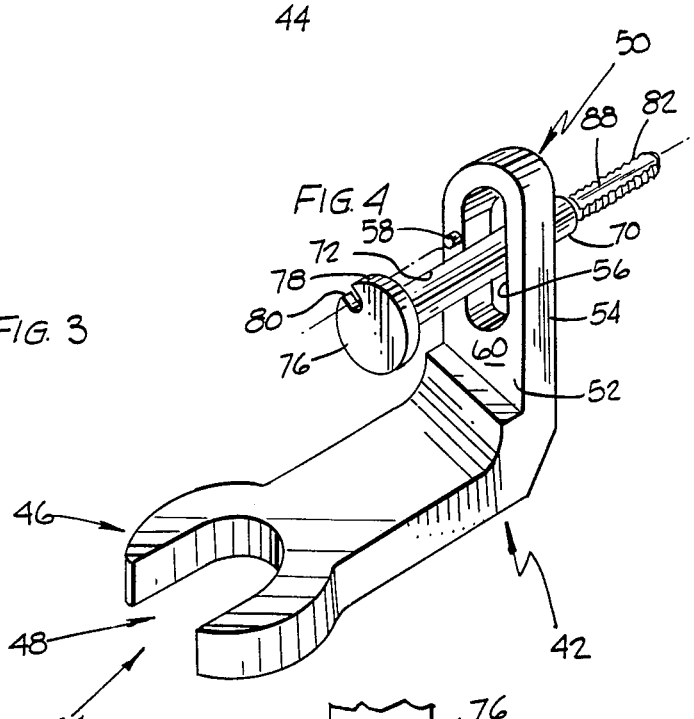
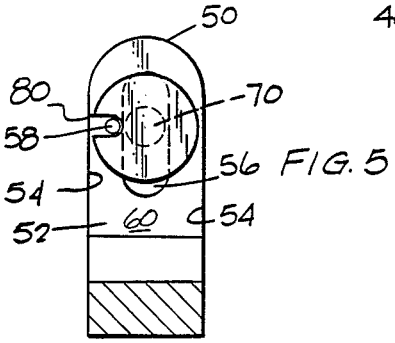
FIG. 5
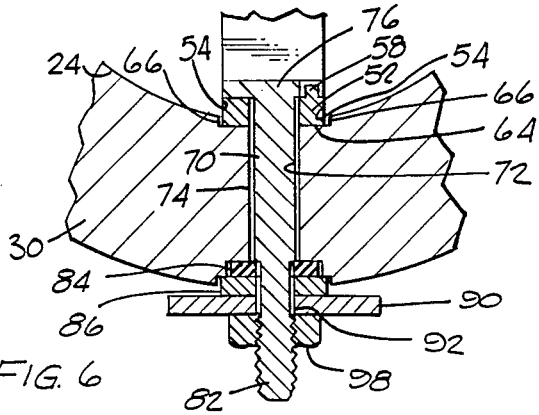
FIG. 6

LIQUID LEVEL CONTROL APPARATUS

FIELD OF THE INVENTION

This invention relates generally to can filling systems and more particularly to a can filling system which is provided with means for accurately controlling the amount of a liquid deposited into a can.

BACKGROUND OF THE INVENTION

Beverage containers, such as beverage cans, are filled with beverages, such as beer, soft drinks, etc., in a can filling machine just prior to the application of the top of the can in a seamer machine. In order to increase productivity and speed of production, can filling machines have been designed to operate at high speeds. Typical high speed can filling machines are capable of filling cans at a rate of about 1,800 cans per minute. In order to meet state and federal requirements, it is necessary that each can passing through the can filling machine be filled with at least the number of fluid ounces stated on the can. In order to accomplish this, it is a general practice to overfill each can and then remove some product by foaming with a bubble breaker and an undercover gasser. This becomes lost product. In one particular operation wherein the cans are for twelve fluid ounces and the product is a particular brand of beer, the weight for a properly filled can is 374 grams. In view of the extremely high number of cans being filled, it is economically advisable to exceed this overfill weight as little as possible. A control resulting in the savings of one gram of the beer per container is very significant. Therefore, it is highly desirable to have an accurate control on the liquid level of the liquid being deposited into a can by each can filler unit on a can filling machine. In one type of can filler units, a vent tube mounted on a stirrup is used to control the liquid level of the fill in a can. In order to adjust the liquid level, it is necessary to remove the stirrup, perform machining operations and remount the stirrup. In another type of a can filler unit, you can use shims to adjust the position of ball cage level controls, but this system is inconvenient and time consuming.

BRIEF DESCRIPTION OF THE INVENTION

This invention provides each can filler unit of a can filling machine with control means for properly positioning a liquid level controller mounted in each can filler unit to ensure that the cans are being accurately filled.

A preferred embodiment of the invention is used in a conventional can filling machine wherein each can filling unit is provided with can filling apparatus which is located within a housing. The level of the liquid being deposited into a can is controlled by a liquid level controller mounted on a tulip which is mounted on the housing so that the liquid level controller extends upwardly into the housing. In accordance with this invention, there are provided mounting means for mounting the liquid level controller on the tulip for providing relative linear sliding movement between the liquid level controller and the tulip. Control means are mounted on an outer surface of the tulip and have a portion thereof extending through the tulip and connected to the mounting means so that movement of the control means produces the relative linear sliding movement between the liquid level controller and the tulip so as to control the level of the liquid being deposited into a can. The mounting means comprises a generally L-shaped elongated member having a support on one end portion thereof for supporting the liquid level controller and a machined surface on the other end portion for linear sliding movement in a linearly extending groove in a portion of the inner surface of the tulip. The control means comprises a shaft rotatably mounted in an opening extending through the sidewall of the tulip. At one end thereof, the shaft is provided with an enlarged head portion which has a radially extending slot formed therein. At the other end, the shaft is provided with operating means for rotating the shaft. The other end of the elongated member has an elongated slot formed therein and a pin projecting outwardly therefrom. The control means are assembled by placing the other end of the elongated member into the groove, passing the shaft through the elongated slot so that the pin is received in the slot in the head portion, continuing the shaft through the opening in the housing and securing the operating means to the shaft so that rotation of the shaft causes sliding movement of the other end portion of the elongated member in the groove. Indicating means are provided for indicating the location of the liquid level controller in the housing.

BRIEF DESCRIPTION OF THE DRAWINGS

An illustrative and presently preferred embodiment of the invention is shown in the accompanying drawings in which:

FIG. 1 is a front elevational view with parts in section of a can filler unit of the prior art;

FIG. 2 is a front elevational view with parts in section of the preferred embodiment of this invention;

FIG. 3 is a partial side elevational view taken from the left side of FIG. 2;

FIG. 4 is an exploded perspective view of the adjusting means of this invention;

FIG. 5 is a front elevational view of FIG. 4; and

FIG. 6 is a cross-sectional view taken on the line 6—6 of FIG. 3.

DETAILED DESCRIPTION OF THE INVENTION

In FIG. 1, there is illustrated the lower part of a can filler unit 2 of a conventional can filling system such. The can filler unit 2 has a housing 4 in which the apparatus for filling a can with a liquid is located. A tulip 6 is slidably mounted on the housing 4 and sealing means 8 are provided between the housing 4 and the tulip 6. The housing 4 has a longitudinal axis 10 which coincides with the longitudinal axis of the can to be filled. A sealing member 12 is located in a cavity in the tulip 6 and is adapted to be moved into contact with the top of a can during the filling operation. A stirrup 14 has support means 16 on one end portion 18 thereof for holding a liquid level controller 20, such as a vent tube, for controlling the amount of the liquid being dispensed by the can filling operation so as to control the liquid level in a can. The other end portion 22 is mounted on the inner surface 24 by a threaded bolt 26 passing through an opening 28 and secured on the sidewall 30 by a nut 32 in threaded engagement with the threaded bolt 26.

The lower part of the can filler unit 40 illustrated in FIG. 2 has many parts that correspond to FIG. 1 and have been identified with the same reference numerals. The mounting means for movably supporting the liquid level controller 20 is illustrated specifically in FIGS.

4–6 and comprises a generally L-shaped elongated member 42 having support means 44 at one end portion 46 thereof comprising an open ended U-shaped slot 48. The liquid level controller 20 is mounted on the support means 44 so that it extends upwardly into the housing 4. The other end portion 50 of the L-shaped elongated member 42 comprises a support arm 52 having a pair of spaced apart sidewalls 54 which have generally planar linearly extending surfaces in parallel relationship. The control means include a linearly extending slot 56 is formed in the support arm 52 and a pin 58 projects outwardly from the surface 60 for purposes described below. In FIG. 6, a groove 64 having linearly extending sidewalls 66 is formed in the inner surface 24 of the tulip 6 and is adapted to receive the sidewalls 54 for permitting sliding movement of the support arm 52 therein.

The control means further include a shaft 70 having a generally cylindrical outer surface 72 passes through an opening 74 in the sidewall 30 of the tulip 6 and the opening 74 has a generally cylindrical inner surface which is slightly larger in diameter than the diameter of the generally cylindrical portion of the outer surface 72 so that the shaft 70 may be rotated therein. An integral enlarged head portion 76 is formed on one end portion of the shaft 70 and has a generally cylindrical outer surface 78 and has an open ended radially extending slot 80 formed therein for purposes described below. The other end portion of the shaft 70 comprises a threaded portion 82 which projects outwardly from the sidewall 30. A seal 84 seated in a recess in the sidewall 30 and a washer 86 are mounted on the shaft 70 to permit relative rotational movement therebetween. The threaded portion 82 has opposite flat sections 88 so that an indicating plate 90 having an opening 92 having a cross-sectional configuration similar to the cross-sectional configuration of the threaded portion 82 including opposite flat portions may be mounted thereon for rotation therewith to provide rotation prevention means for preventing relative rotation between the indicating plate 92 and the other end of the shaft. In FIG. 3, the indicating plate 90 has indicia 94 for cooperating with a mark 96 on the sidewall 30 to indicate the position of the liquid level controller 20. A nut 98 is threaded on to the threaded portion 82 to provide frictional forces between the support arm 52 and the groove 64 to hold the support arm 52 at a desired adjusted position in the groove 64.

In operation, the support arm 52 is placed in the groove 64 and the threaded portion 82 of the shaft 52 is passed through the slot 56 into the opening 74. The movement of the shaft 70 is continued until the enlarged head portion 76 contacts the surface 60 and the pin 58 is located in the slot 80. The seal 84, the washer 86, the indicating plate 90 and the nut 98 are placed on the threaded portion 82 and the nut 98 is tightened so that the support arm 52 is in engagement with the groove 64. During tightening of the nut 98, the indicating plate 90 and the shaft 70 are held against rotation so that the indicating plate 90 is in proper position relative to the mark 96. The flat sections 88, the slot 80 and the pin 58 are located relative to each other so that when the indicating plate 90 is on the threaded portion 82 and the zero indicia is opposite the mark 96, the liquid level controller 20 will be located at the position at which it is designed to operate. When it is desired to change the position of the liquid level controller 20, the nut 98 is loosened and the indicating plate 90 is rotated in the plus or minus direction and the nut 98 is tightened to hold the shaft 70 in the adjusted position. Therefore, the indicating plate 90 provides operating means so that rotation thereof rotates the shaft 70 to cause sliding movement of the support arm 52 and the control means. The rotation of the shaft 70 rotates the enlarged head portion 76 so that the walls defining the radial slot 80 bear against the pin 58 to move the support arm 52 in a linear direction in the groove 64. The linear direction of movement of the support arm 52 is parallel to the longitudinal axis 10. When all of the can filler units 40 have been mounted on a can filling machine, the machine is operated and the liquid level in the cans filled by each can filler unit 40 is measured by conventional apparatus. Thereafter, each liquid level controller 20 in each can filler unit 40 is adjusted in accordance with the measurements.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed:

1. In a can filling operation wherein the can filling apparatus is located within a housing having a longitudinal axis and wherein the level of the liquid being deposited into a can is controlled by a liquid level controller located within the housing, the improvement comprising:

mounting means for mounting said liquid level controller within said housing for providing relative movement between said liquid level controller and said housing;

a tulip having a sidewall having an inner surface slidably mounted on said housing and having a portion thereof adapted to contact the top of a can to be filled; and control means mounted on an outer surface of said tulip and having a portion thereof extending through said tulip and connected to said mounting means so that movement of said control means produces said relative movement between said liquid level controller and said housing so as to adjust the liquid level controller to control the level of said liquid being deposited into said can.

2. The invention as defined in claim 1 wherein:

said relative movement between said liquid level controller and said housing is in a linear direction.

3. The invention as in claim 2 wherein said mounting means comprises:

a generally L-shaped elongated member;

support means on one end portion of said elongated member for supporting said liquid level controller;

the other end portion of said elongated member comprises a support arm having a pair of spaced apart sidewalls having generally planar surfaces in parallel relationship;

a groove formed in a portion of the inner surface of said tulip and having linear extending side walls for receiving said pair of sidewalls of said support arm for linear sliding movement in said linear extending sidewalls; and said control means holding said support arm in a desired position in said groove and to apply forces thereto to provide for said linear sliding movement of said support arm in said groove.

4. The invention as in claim 3 wherein said control means comprises:

an opening extending in a radial direction through said sidewall of said tulip;

a shaft extending through said opening and rotatably mounted therein;

an enlarged head portion on one end of said shaft;

a linearly extending slot in said enlarged head portion;

a closed slot in said support arm and being dimensioned so that said shaft will pass through said closed slot but said enlarged head portion will not;

a pin projecting outwardly from said support arm and located in said linearly extending slot in said enlarged head portion; and operating means secured on the other end of said shaft and outside of said tulip so that said operating means may be rotated to rotate said shaft and said enlarged head portion to cause sliding movement of said support arm and said control means through engagement of said pin in said linearly extending slot.

5. The invention as in claim 4 wherein:

said enlarged head portion has a generally cylindrical outer surface; and said linearly extending slot extends in a radial direction.

6. The invention as in claim 5 wherein:

said groove extends in a direction parallel to said longitudinal axis of said housing.

7. The invention as in claim 4 and further comprising:

a fixed mark on said sidewall;

an indicating plate mounted on said other end of said shaft and having indicia thereon for cooperating with the fixed mark for indicating the position of said liquid level controller in said housing.

8. The invention as in claim 7 and further comprising:

rotation prevention means for preventing relative rotation between said indicating plate and said other end of said shaft.

9. The invention as in claim 8 wherein said operating means comprises:

a threaded portion on said other end of said shaft;

opposite flat sections on said threaded portion;

an opening in said indicating plate having a cross-sectional configuration corresponding to said cross-sectional configuration of said threaded portion so that there is no relative rotational movement between said indicating plate and said other end of said shaft;

a nut in threaded engagement with said threaded portion so that when said nut is tightened, said shaft and indicating plate are held against rotation and said support arm is held in a fixed relationship with said groove and when said nut is loosened, rotation of said indicating plate will rotate said shaft to move said support arm in a desired linear direction.

* * * * *